US005586597A

United States Patent [19]

Taleyarkhan

[11] Patent Number: 5,586,597

[45] Date of Patent: Dec. 24, 1996

[54] METHOD TO PREVENT/MITIGATE STEAM EXPLOSIONS IN CASTING PITS

[75] Inventor: Rusi P. Taleyarkhan, Knoxville, Tenn.

[73] Assignee: Lockheed Martin Energy Systems, Inc., Oak Ridge, Tenn.

[21] Appl. No.: 573,813

[22] Filed: Dec. 18, 1995

[51] Int. Cl.[6] ..... B22D 11/124; B22D 11/22

[52] U.S. Cl. ..... 164/487; 164/128; 164/152; 164/444

[58] Field of Search ..... 164/485, 486, 164/487, 128, 444, 152, 153

[56] References Cited

U.S. PATENT DOCUMENTS

| | | | |
|---|---|---|---|
| 3,368,607 | 2/1968 | Maddigan | 164/486 X |
| 4,286,647 | 9/1981 | Honda et al. | 164/153 |
| 4,651,804 | 3/1987 | Grimes et al. | 164/487 X |
| 4,781,239 | 11/1988 | Cans et al. | 164/486 |

FOREIGN PATENT DOCUMENTS

| | | | |
|---|---|---|---|
| 1-233049 | 9/1989 | Japan | 164/485 |
| 1-233050 | 9/1989 | Japan | 164/485 |
| 1-233051 | 9/1989 | Japan | 164/485 |

OTHER PUBLICATIONS

Long, George, "Explosions of Molten Aluminum in Water—Cause and Prevention", *Metal Progress*, May 1957, p. 107–112.

*Primary Examiner*—J. Reed Batten, Jr.
*Attorney, Agent, or Firm*—Patrick D. Guettner; Harold W. Adams

[57] ABSTRACT

Steam explosions can be prevented or mitigated during a metal casting process by the placement of a perforated flooring system in the casting pit. An upward flow of compressed gas through this perforated flooring system is introduced during the casting process to produce a buffer layer between any spilled molten metal and the cooling water in the reservoir. This buffer layer provides a hydrodynamic layer which acts to prevent or mitigate steam explosions resulting from hot, molten metal being spilled into or onto the cooling water.

17 Claims, 1 Drawing Sheet

METHOD TO PREVENT/MITIGATE STEAM EXPLOSIONS IN CASTING PITS

The United States Government has rights in this invention pursuant to Contract No. DEAC05-84OR21400 between the United States Department of Energy and Lockheed Martin Energy Systems, Inc.

CROSS-REFERENCE TO RELATED APPLICATIONS

None

Field of the Invention

The present invention relates to the field of metal, particularly aluminum, casting, and more particularly to the technology of prevention and mitigation of explosions which frequently occur when aluminum is cast into ingots.

Background of the Invention

In the production of one of our most desirable and usable metals, molten aluminum is reduced from the bauxite ore and cast into ingots using casting machines of several varieties. This casting process and equipment normally uses water as a quencher and coolant when hot molten aluminum flows into ingot molds. The casting process takes place over a casting pit. The bottom portion of a casting pit serves as a reservoir or pool of cooling water. The cooling water is pumped and circulated continuously from the casting pit while hot molten aluminum is poured into molds. It is into the casting pit below that the molten aluminum sometimes falls during this process. The water becomes trapped beneath the molten aluminum and becomes immediately superheated creating a steam explosion. This hazard exists in all types of aluminum casting processes, whether they be vertical, horizontal or continuous. Explosions from this event can be minor or catastrophic. Catastrophic explosions in the past have killed and injured many people as well as destroyed equipment and interrupted production.

An intense study of methods to explain, prevent or mitigate the explosion hazard has been underway for at least forty years in the aluminum industry. Much progress has been made in explaining the reasons for the explosions and understanding the physics involved, but prevention and mitigation still represent nagging problems. Several techniques and materials have been and are used currently to address the problem. The application of certain materials such as Tarset (a trade name owned by Courtald's, Inc.) to vulnerable surfaces has been concluded, through years of experimentation, to assist nominally in the mitigation of explosions. Such materials address only the factors of suppression and triggerability in the explosions, and the use of such materials represents the state-of-the-art method for preventing and mitigating explosions.

The present invention addresses the explosion problem from a different aspect. An understanding of the phenomenologies involved in the explosion process itself is used to create an approach heretofore not taken. Through studies and experiments of these phenomenologies, the present invention represents a novel method with which to successfully mitigate, if not altogether prevent, explosions in the aluminum ingot casting process.

OBJECTS OF THE INVENTION

Accordingly, it is an object of the present invention to provide a new and improved method with which to prevent or mitigate steam explosions during the aluminum casting process.

It is another object to provide this method which is less expensive than methods currently in use.

It is yet another object to eliminate the currently used methods and materials which merely provide coatings in the vulnerable areas of explosions.

It is yet a further object to eliminate materials currently used and their detrimental environmental effects.

It is a further object to eliminate time-consuming inspections required with the use of current methods of coating vulnerable areas.

It is still another object to eliminate expensive replacement items destroyed by explosions.

It is still a further object to eliminate the production of toxic fumes generated with the use of current coating materials.

Yet another object is to reduce the mechanical shock and vibration energy when molten aluminum interacts with water.

Another object is for the technology of the present invention be made adaptable to other metal casting applications.

Further and other objects of the present invention will become apparent from the description contained herein.

SUMMARY OF THE INVENTION

In accordance with one aspect of the present invention, the foregoing and other objects are achieved by the method of providing a perforated floor or gas buffer system consisting of a piping network near the bottom of a metal casting pit and below the casting pit water, introducing a compressed inert gas with this system to produce a buffer between the cooling water and any spilled hot molten aluminum, thereby controlling or preventing the creation of hazardous phenomenologies associated with steam explosions induced when water is trapped beneath very hot or molten metal.

For a better understanding of the present invention, together with other and further objects, advantages and capabilities thereof, reference is made to the following disclosure and appended claims in connection with the above-described drawings.

DETAILED DESCRIPTION OF THE INVENTION

Figure 2:
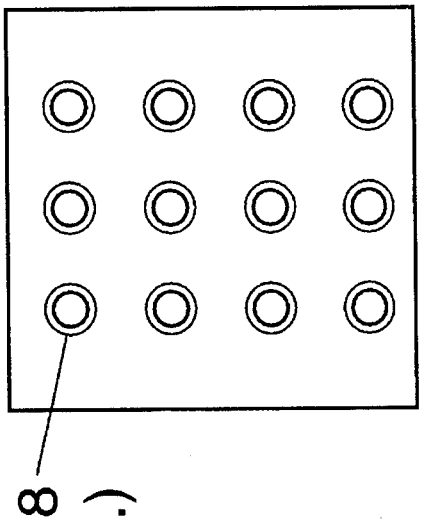
FIG. 2 is a plan view of the perforated floor and piping system with gas ejection holes shown.
Figure 3:
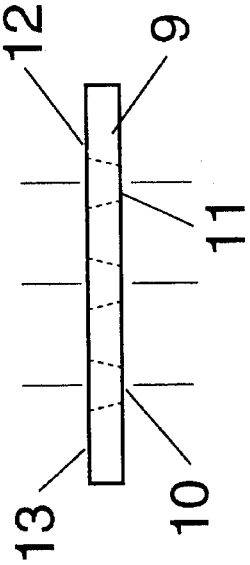
FIG. 3 is a side view of the perforated floor and piping system.
Figure 1:
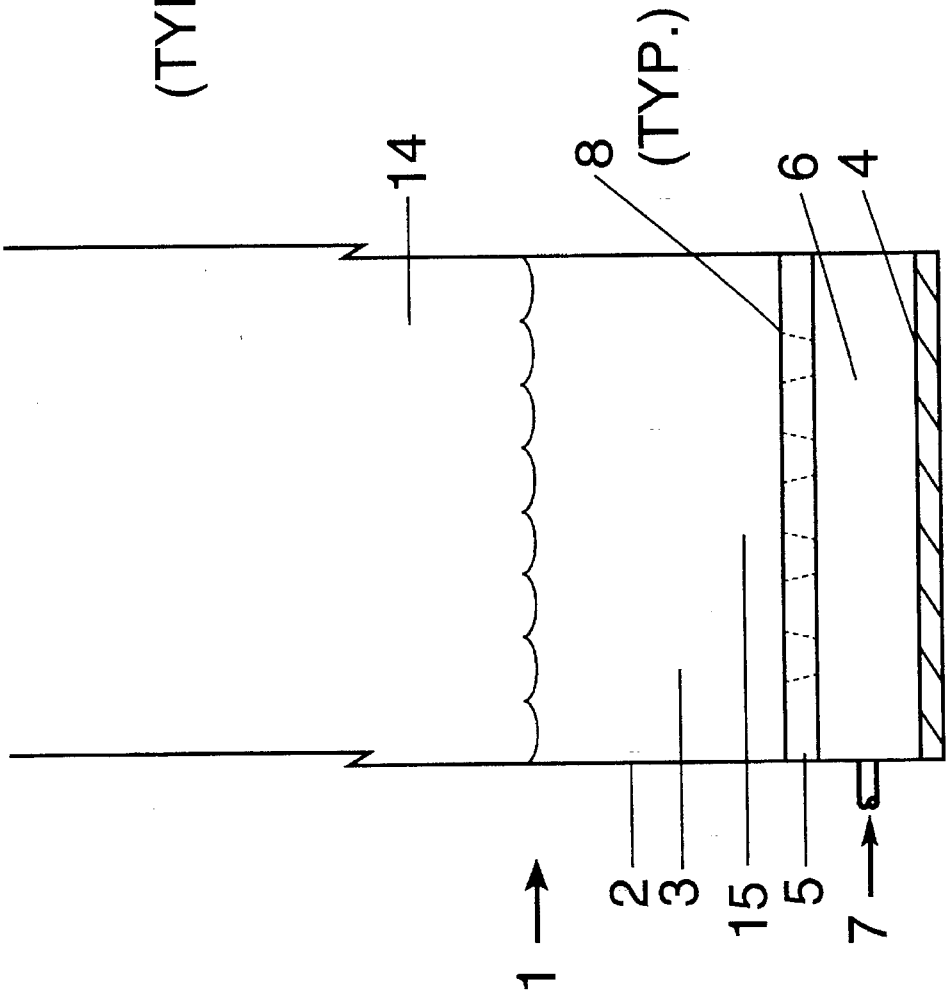
FIG. 1 is an elevation view of the lower portion of a typical aluminum casting pit.

With reference now to the drawings, and in particular to FIGS. 1–3 thereof, a new and novel method embodying the principles and concepts of the present invention, and generally designated by reference numerals in the drawings, will be herewith described in detail.

The method is manifested in the bottom portion 1 of a typical aluminum casting pit as shown in FIG. 1. To briefly familiarize the reader with the basic parts of a casting pit, FIG. 1 is adequate for that purpose. The bottom portion 1 contains the cooling water reservoir 2. The cooling water 3 is pumped from this reservoir 2 and circulated around the molds (not shown) above as molten aluminum is poured into the molds to form solid ingots. It is into this cooling water reservoir 2 that hot molten aluminum is sometimes spilled during the casting process taking place above. When the hot molten aluminum is spilled into the water 3, the water 3 trapped beneath is instantly superheated, creating a powerful steam explosion.

The present invention uses a different approach in addressing the explosion hazard than the current method of coating the pit's bottom surface 4 as described in the "Background" (infra). The present invention uses a perforated flooring system 5 placed above the bottom surface 4 to create a chamber 6. A compressed gas 7 (preferably inert, such as nitrogen), is introduced into this chamber 6 under a certain pressure, preferably between 1 and 10 psig, and the gas 7 is thereby forced upward into the cooling water 3 through the holes 8 of the perforated flooring system 5. Turbulence in the cooling water 3 is created by this upward flow of gas 7, and it is this addition of compressed gas 7 to the melt-water interfacial area that steam vapor film, which has been found to act upon the phenomenologies of the molten aluminum-water interaction, mitigates or even prevents a steam explosion from occurring. This compressed gas 7 also acts to absorb any mechanical shock waves that sometimes are generated during the casting process. Such shock waves are now known to trigger explosions when hot molten metal comes in contact with water.

The flooring system 5 is perforated with holes 8 as shown in FIGS. 1, 2 and 3. In a preferred embodiment, these holes 8 are spaced no more than two and one-half inches apart. Also in a preferred embodiment, these holes 8 have a taper 9 such that a smaller diameter 10 is located at the bottom surface 11 of the flooring system 5 and a larger diameter 12 of the holes 8 is located at the top surface 13 of the flooring system 5. This tapering of the holes 8 facilitates the upward flow of the compressed gas 7, acts as a flow diode to prevent water flow downwards, and facilitates the creation of turbulence at the bottom of the cooling water reservoir 2. The flooring system 5 is preferably constructed in square or rectangular sections of no more than one inch thickness and no less than one-half inch thickness to expedite the removal and repair of the flooring system 5 as needed. Preferably the flooring system 5 is constructed of stainless steel for reliability and long-life. Flooring system sections with different hole diameters can also be interchanged in order to meet different requirements and applications of the casting process. An alternate embodiment is the use of perforated pipe sections rather than square or rectangular floor sections.

The chamber 6 between the flooring system 5 and the bottom surface 4 of the casting pit 1 is preferably less than four inches in height.

The compressed gas 7 introduced into the chamber 6 is preferably an inert gas such as nitrogen, but compressed air can also be used. The compressed gas 7 is introduced preferably at a pressure between 1 and 10 psig, into the sides of the chamber 6 when the flooring system comprises floor sections.

The compressed gas 7 forms bubbles in the cooling water 3 as it rises through the holes 8 in the perforated flooring system 5. This compressed gas 7 prevents or mitigates water entrapment at contact surfaces and furthermore forms a hydrodynamic boundary layer 15 at the bottom of the cooling water reservoir 2. This layer 15 acts as a cushion around any molten aluminum that spills down accidentally into the cooling water 3. This cushion around the pieces or droplets of molten aluminum result in enhanced stability characteristics for the water-aluminum interaction and resist the possibility of rapid fragmentation that is necessary for a steam explosion. In addition, the bubbles break up the melt stream from the casting process into small jet-like streams that will not manifest into steam explosions. The compressed gas 7 also provides considerable absorption of mechanical shocks and vibration energy which act as explosion triggers and are induced by hot metal coming in contact with water and lead to steam explosions.

The area 14 above the cooling water reservoir 2 is also subject to steam explosions which are created by water collected there. An alternative embodiment to the present invention is to provide it in a different location within a casting pit. This embodiment entails cooling water reservoirs and perforated floor systems in these vulnerable areas above the cooling water reservoir 2.

While there has been shown and described what are at present considered the preferred embodiments of the invention, it will be obvious to those skilled in the art that various changes and modifications can be made therein without departing from the scope of the inventions defined by the appended claims.

What is claimed is:

1. A method of preventing and mitigating a steam explosion in a casting pit, comprising the steps of:

(a) providing a casting pit having a bottom and a cooling water reservoir;

(b) providing a floor system, having perforations, positioned in said cooling water reservoir in said casting pit; and (c) introducing a compressed gas upward through said floor system into said cooling water reservoir during a casting operation.

2. A method as recited in claim 1, wherein said floor system comprises a plurality of sections adaptable for removability and positioning.

3. A method as recited in claim 1, wherein said floor system comprises an interconnected piping network.

4. A method as recited in claim 1, wherein said floor system is positioned at said bottom of said casting pit.

5. A method as recited in claim 1, wherein said perforations in said floor system are tapered.

6. A method as recited in claim 5, wherein said perforations are spaced no more than two and one-half inches apart.

7. A method as recited in claim 5, wherein said perforations are tapered in a direction to increase said flow of said compressed gas upward and to prevent backflow of said water.

8. A method as recited in claim 1, wherein said compressed gas is selected from the group consisting of air and inert gases.

9. A method as recited in claim 1, wherein said compressed gas is pressurized at between 1 and 10 psig.

10. A method as recited in claim 1, wherein said compressed gas is introduced at a rate of flow sufficient to prevent water entrapment and to create a bubbly flow.

11. A method of preventing and mitigating a steam explosion in a casting pit, comprising the steps of:

(a) providing a cooling water reservoir in a casting pit vulnerable to water collection and entrapment;

(b) providing a perforated piping system in said cooling water reservoir for introducing a compressed gas through said cooling water reservoir during a casting operation; and (c) introducing a compressed gas through said perforated piping system into said areas vulnerable to water collection during a casting operation.

12. A method as recited in claim 11, wherein said casting pit is an aluminum casting pit.

13. A method of preventing and mitigating a steam explosion in an aluminum casting pit, comprising the steps of:

(a) providing an aluminum casting pit having a cooling water reservoir and a bottom;

(b) providing a perforated floor system positioned in said cooling water reservoir in said aluminum casting pit; and (c) introducing a compressed gas upward through said perforated floor system into said cooling water reservoir during a casting operation.

14. A method as recited in claim 13, wherein said perforated floor system comprises a plurality of sections adaptable for removability and positioning.

15. A method as recited in claim 13, wherein said perforated floor system comprises an interconnected piping network.

16. A method as recited in claim 13, wherein said perforated floor system is positioned at said bottom.

17. A method as recited in claim 13, wherein said compressed gas is scheduled from the group consisting of air and inert gases.

* * * * *